US006908243B1

(12) United States Patent
Lai

(10) Patent No.: US 6,908,243 B1
(45) Date of Patent: Jun. 21, 2005

(54) SEPARABLE CUTTING MECHANISM FOR PRINTER

(75) Inventor: Jin-Sheng Lai, Hsi Chih (TW)

(73) Assignee: Great Computer Corp., Taipei Hsien (TW)

( * ) Notice: Subject to any disclaimer, the term of this patent is extended or adjusted under 35 U.S.C. 154(b) by 5 days.

(21) Appl. No.: 10/744,765

(22) Filed: Dec. 30, 2003

(51) Int. Cl.[7] ..... B41J 11/70
(52) U.S. Cl. ..... 400/621; 400/621.1; 101/93.07
(58) Field of Search ..... 400/621, 621.1, 400/593, 352; 101/97.03

(56) References Cited

U.S. PATENT DOCUMENTS 4,504,162 A * 3/1985 Speraggi ..... 400/621
4,525,088 A * 6/1985 Shipos et al. ..... 400/621
4,979,838 A * 12/1990 Yokota et al. ..... 400/621
5,296,872 A * 3/1994 Caamano ..... 346/24
5,482,389 A * 1/1996 Bickoff et al. ..... 400/621
6,412,993 B1 * 7/2002 Silverbrook ..... 400/621
6,425,700 B1 * 7/2002 Silverbrook et al. ..... 400/621

* cited by examiner

*Primary Examiner*—Andrew H. Hirshfeld
*Assistant Examiner*—Dave A. Ghatt
(74) *Attorney, Agent, or Firm*—Dennison, Schultz, Dougherty & MacDonald

(57) ABSTRACT

A separable cutting mechanism for a printer comprises: a printing device with rollers used for mounting on a rail of the printer to move transversely; a cutting-knife unit with a carrier having rollers thereon to mount the cutting-knife unit on the rail of the printer and to be installed in juxtaposition with a plurality of printing heads; and an electromagnetic connector provided between the printing device and the carrier of the cutting-knife unit, the electromagnetic connector is provided with a magnetizing coil to generate attraction or release action when the printer is operated. Thereby, the cutting-knife unit and the printing device can be controlled to mutually attract with each other or can be separated for independent operations.

3 Claims, 5 Drawing Sheets

SEPARABLE CUTTING MECHANISM FOR PRINTER

BACKGROUND OF THE INVENTION

1. Field of the Invention

The present invention is related to a separable cutting mechanism for a printer, and especially refers to a simple cutting mechanism structure for a printer, of which a cutting-knife unit and a printing device can be mutually attracted to integrate with each other and can be separated for independent operations; it is applicable to cutting device on a printer.

2. Description of the Prior Art

Referring to FIG. 1, a current large advanced printer 1 is provided on a printing device with an integrated printing head 11 to print out graphics and texts, and with a cutting-knife unit 12 attached to printer 1 to cut the desired graphics and texts on paper.

However, the printing head 11 and the cutting-knife unit 12 of the conventional printer 1 are designed integratedly; they must simultaneously move along on a rail during operation. The printing head 11 is designed to carry multiple ribbon cartridges 13 during color printing, its moving speed is not fast, and weight added by the cutting-knife unit 12 will not affect the normal outputting work of the printing head 11 during printing. However, the cutting-knife unit 12 must drag the printing head 11 to move along on the rail during cutting, thus loading increasing will largely affect its moving speed. In particular, if the knife's vertical movements are sharp and the cutting-knife unit moves smoothly, then the lines cut will be smooth; otherwise, if the knife's movement are not sharp and the cutting-knife unit moves slowly, the cutting quality will be poor.

In view of the above stated defects, the inventor of the present invention developed the present invention based on years of experience and research to increase the speed and precision of cutting.

SUMMARY OF THE INVENTION

The main objective of the present invention is to provide a simple structure of separable cutting mechanism for a printer, of which a cutting-knife unit and a printing device can be mutually attracted to integrate with each other and can be separated for independent operations during cutting.

To achieve the objective, the separable cutting mechanism for a printer of the present invention comprises: a printing device with rollers used for mounting on a rail of the printer to move transversely; a cutting-knife unit with a carrier having rollers thereon to mount the cutting-knife unit on the rail of the printer and to be installed in juxtaposition with a plurality of printing heads; and an electromagnetic connector provided between the printing device and the carrier of the cutting-knife unit, the electromagnetic connector is provided with a magnetizing coil to generate attraction or release action when the printer is operated.

Therefore, the cutting-knife unit and the printing device can be controlled to mutually attract with each other or separate for independent operations.

The present invention will be apparent after reading the detailed description of the preferred embodiment thereof in reference to the accompanying drawings.

DETAILED DESCRIPTION OF THE PREFERRED EMBODIMENT

Figure 1:
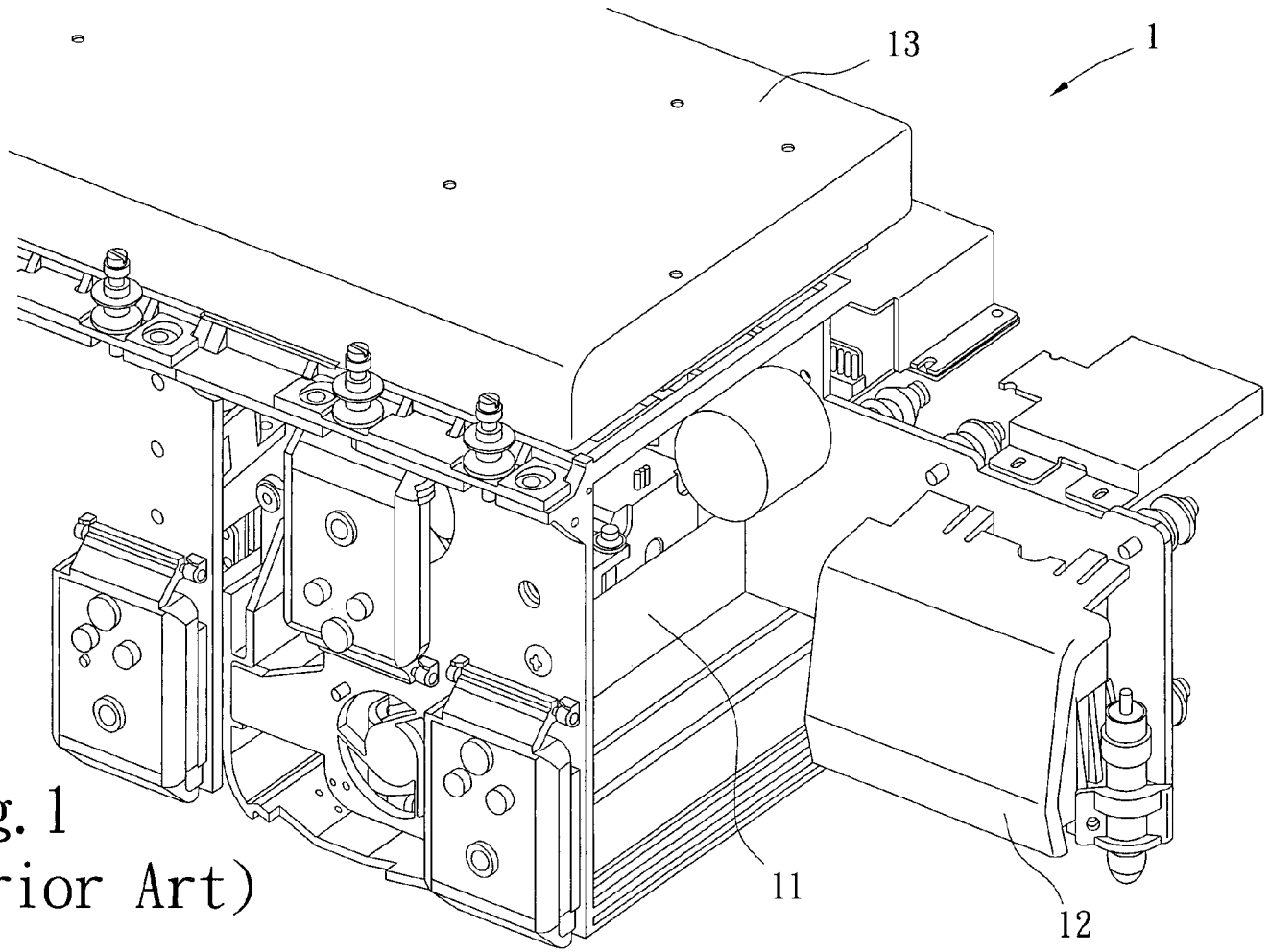
Fig. 1 (Prior Art)
FIG. 1 is a schematic perspective view showing connection of a cutting-knife unit with a printing head of a conventional printer.
Figure 2:
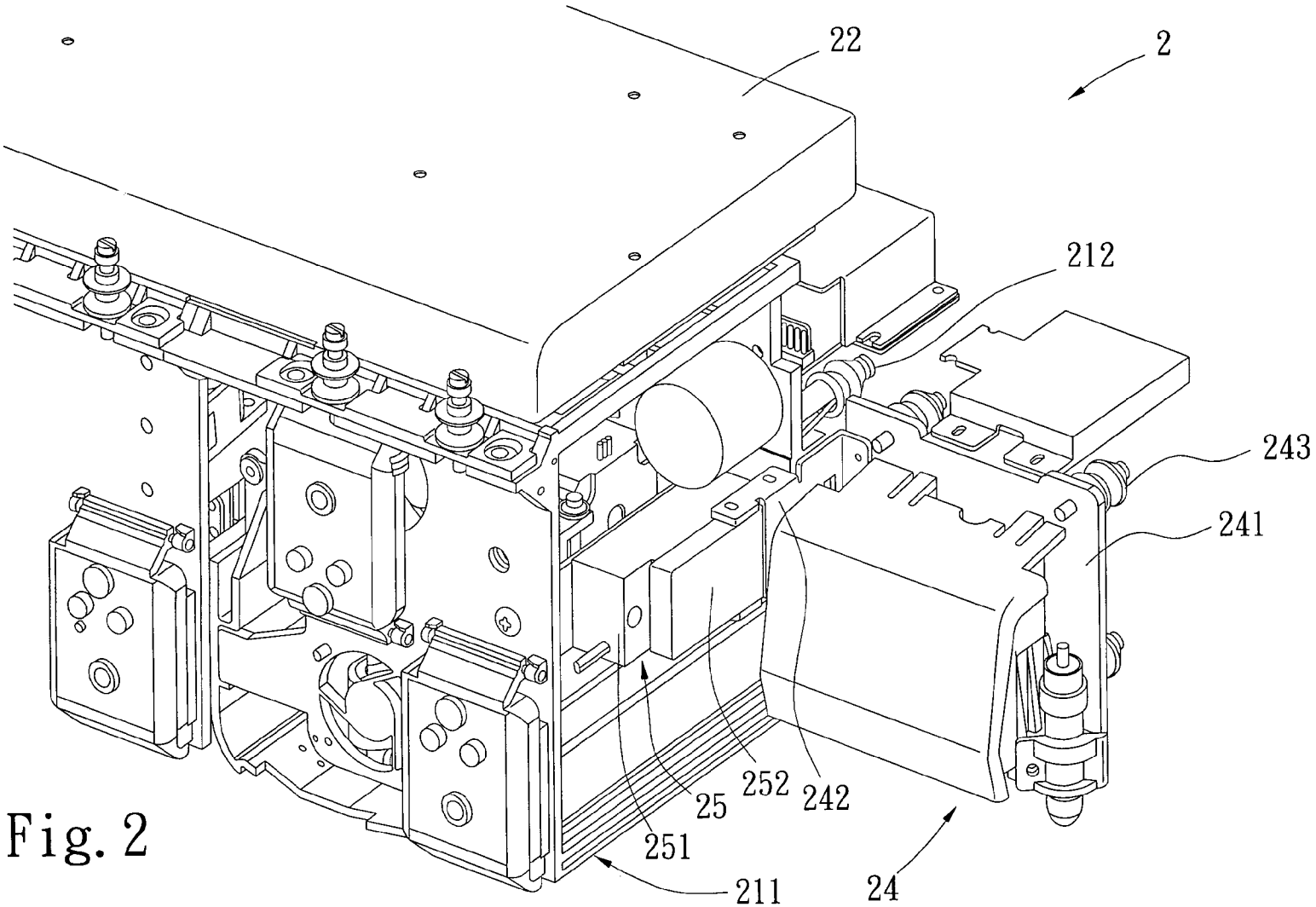
FIG. 2 is a schematic perspective view showing connection of a cutting-knife unit with a plurality of printing heads in a separable cutting mechanism of an embodiment of the present invention for a printer.
Figure 3:
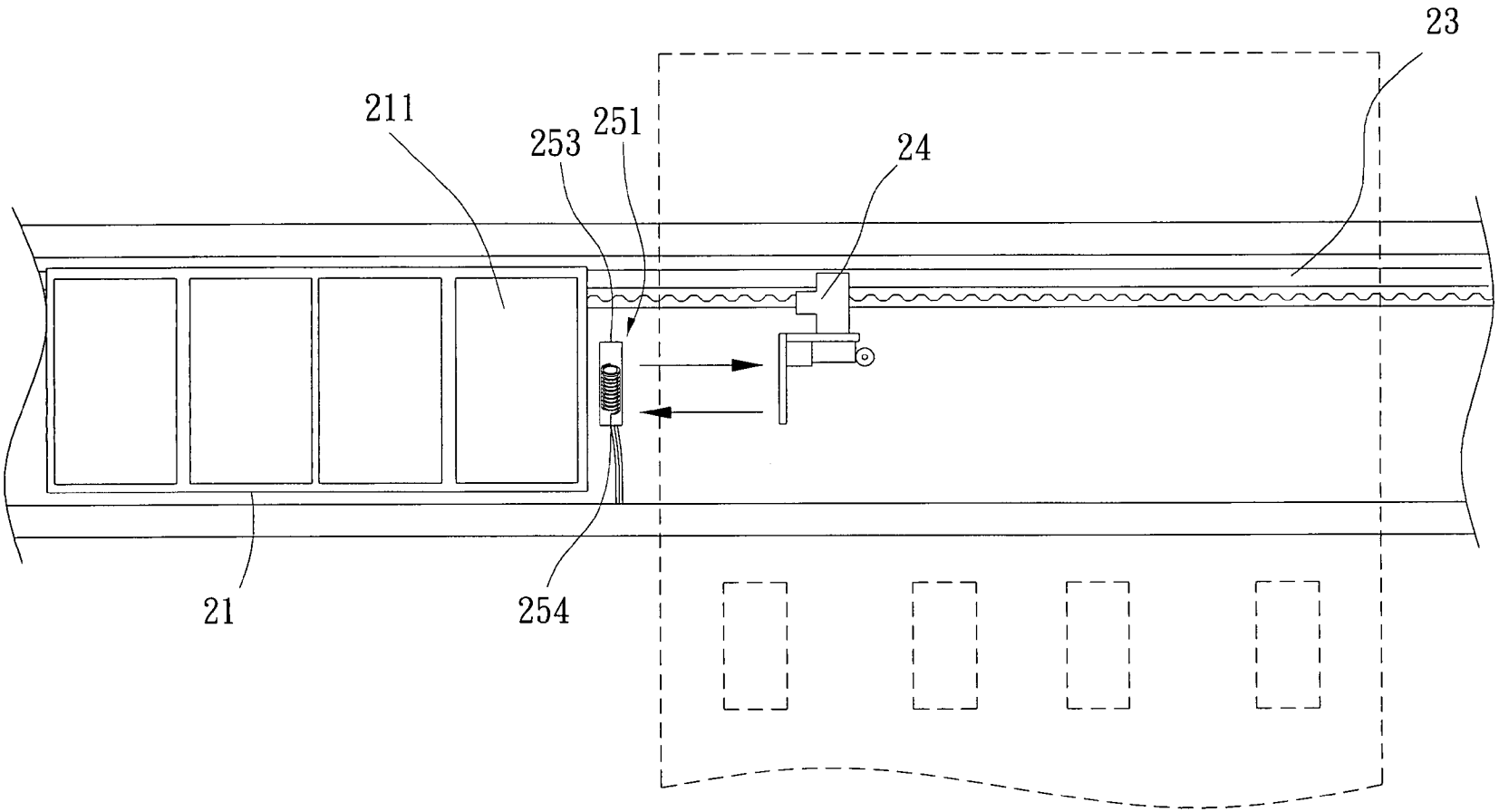
FIG. 3 is a top view showing the cutting-knife unit and the printing heads of the embodiment of the present invention.

Referring to FIGS. 2 and 3 showing a separable cutting mechanism 2 for a printer of an embodiment of the present invention, it is comprised of:

a printing device 21 composed of four printing heads 211 having four monochromatic cartridges 22, and provided on edges thereof with a plurality of rollers 212 to mount the printing device 21 on a rail 23 of the printer to move transversely;

a cutting-knife unit 24 composed of a carrier 241 having a cutting knife thereon; the carrier 241 is provided on one edge thereof with a locking plate 242, and has a plurality of rollers 243 on one side thereof to mount the cutting-knife unit 24 on the rail 23 of the printer and being installed in juxtaposition with the printing heads 211; and an electromagnetic connector 25 provided between the printing heads 211 and the carrier 241 of the cutting-knife unit 24; the electromagnetic connector 25 is composed of a electromagnetic block 251 and a magnetically attractable metallic block 252. The metallic block 252 is rectangular and has on one edge thereof locking holes to be locked onto the locking plate 242 of the carrier 241 of the cutting-knife unit 24. The electromagnetic block 251 is locked onto a lateral side of the outermost printing head 211 on the printing device 21. The electromagnetic block 251 has a case 253 that has locking holes on both end, the case 253 is provided therein with a magnetizing coil 254 and is provided externally thereof with a magnetic conductive surface, so that the electromagnetic block 251 can provide attraction and releasing function on the metallic block 252 during operations.

Figure 4:
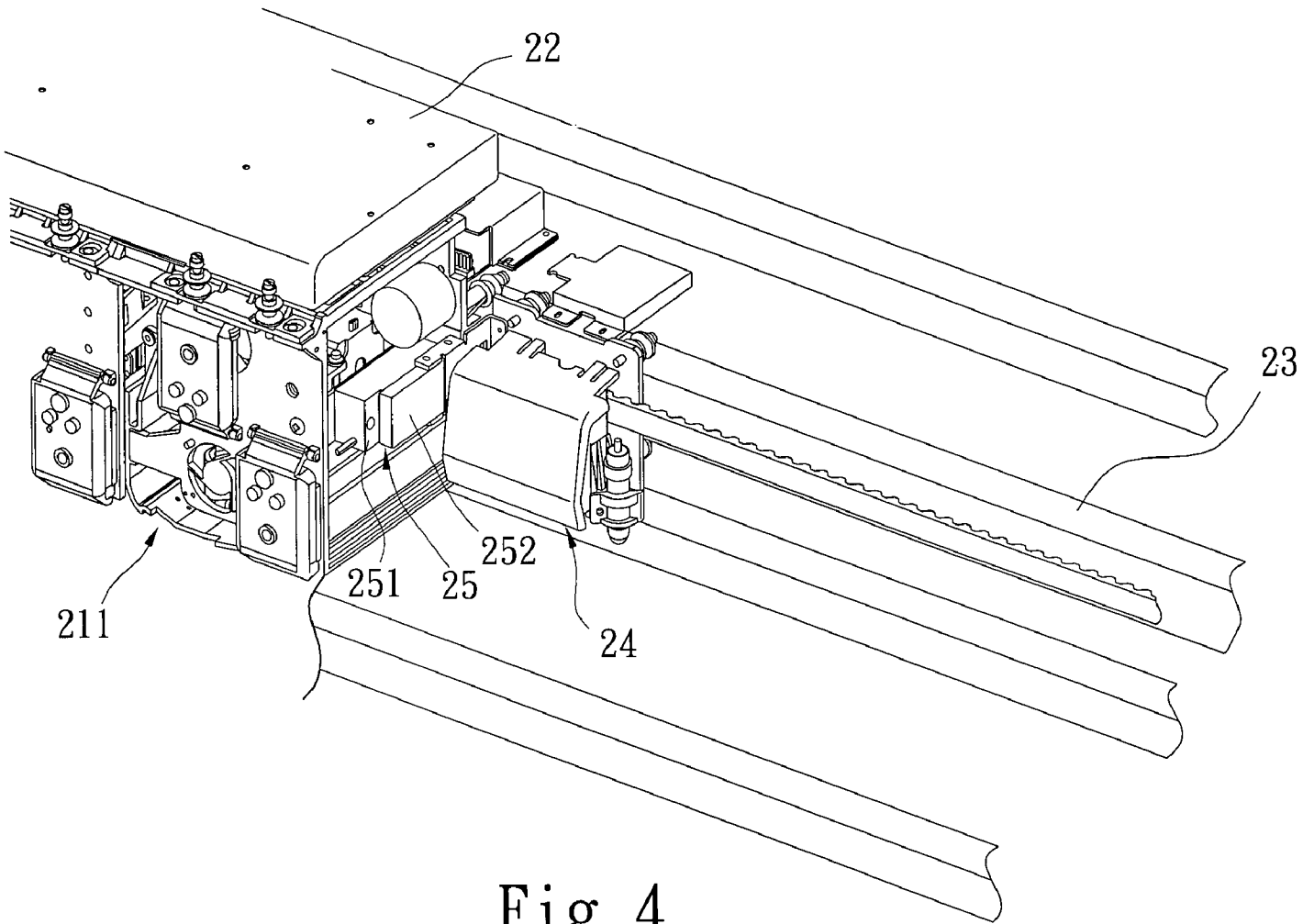
FIG. 4 is a perspective view showing the appearance of the embodiment of the present invention with the cutting-knife unit and the printing heads mutually attracted and mounted on a rail.
Figure 5:
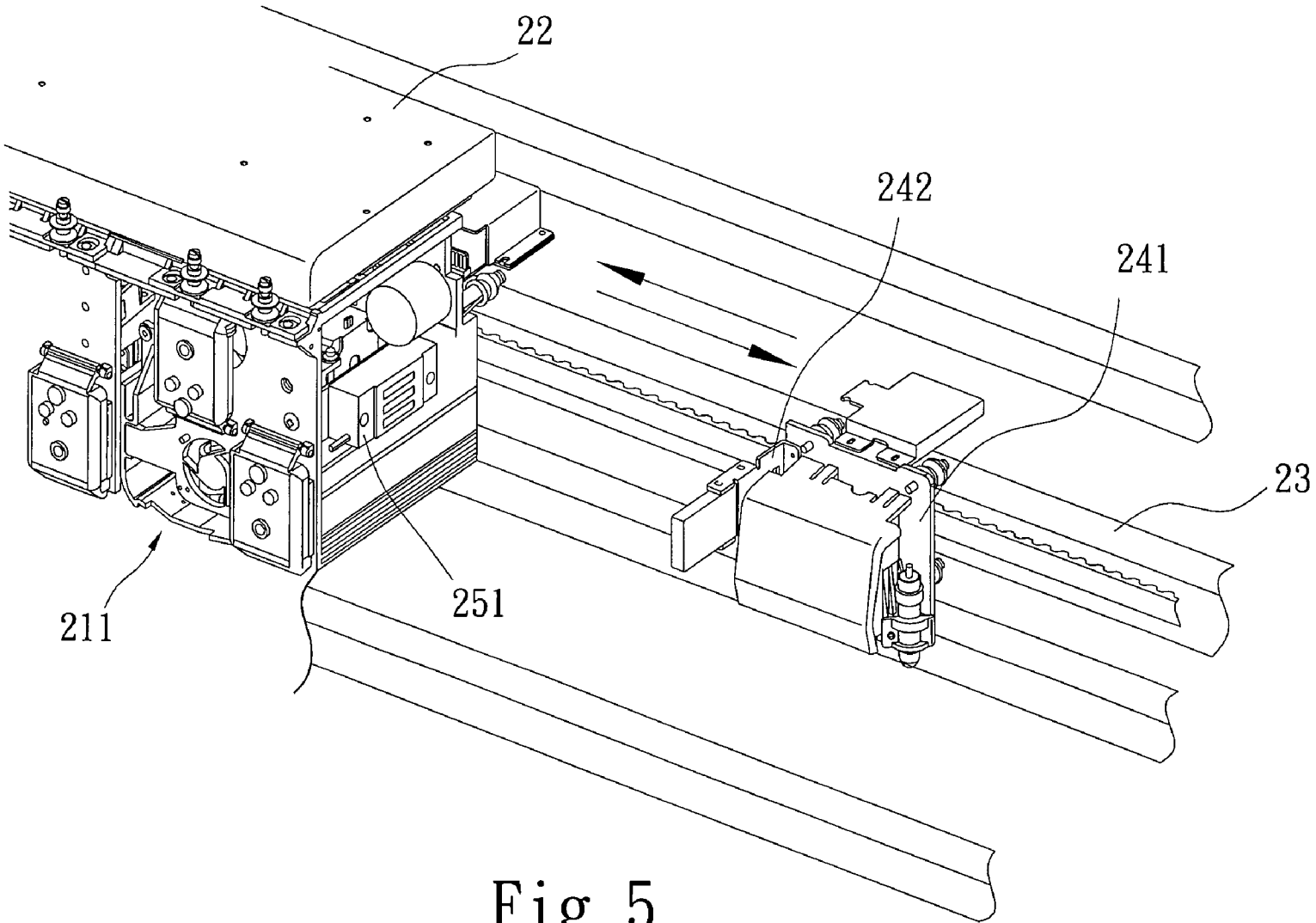
FIG. 5 is a schematic perspective view showing the cutting-knife unit separated from the printing heads while moving on the rail in use of the embodiment of the present invention.

When practicing, as shown in FIGS. 3–5, the electromagnetic block 251 provided on the electromagnetic connector 25 is locked on the outermost printing head 211 of the printing device 21, while the metallic block 252 is locked onto the locking plate 242 on the carrier 241 of the cutting-knife unit 24. Therefore when printing, the printer can have the magnetizing coil 254 in the magnetic block 251 controlled, so that the metallic block 252 and the magnetic block 251 can mutually attract each other (as shown in FIG. 4).

The printing device 21 integrated during printing graphics and texts and the cutting-knife unit 24 in front of it can move jointly along on the rail 23.

When cutting, the printer can demagnetize the magnetizing coil 254 in the electromagnetic block 251 to release the metallic block 252, so that the cutting-knife unit 24 can be separated from the printing heads 211 to move independently on the rail 23 during cutting (as shown in FIG. 5).

Accordingly, the present invention has the following advantages:

1. The separable cutting mechanism for a printer of the present invention applies to the principle of magnetism to allow a cutting-knife unit and a plurality of printing heads to be mutually attracted or separated during operations. Thus with the better mobility, it can effectively overcome the cutting defects of need to drag the printing device resided in the conventional printers.

2. In the present invention, the cutting-knife unit and the printing heads can be separated optionally. Thereby when cutting, the cutting-knife unit does not carry extra weight, and can independently move to and fro along on the rail, so to largely increase speed and precision of cutting.

According to the above stated, the present invention can achieve its expected objective to provide a separable cutting mechanism for a printer, it is extremely practicable.

Having thus described my invention, what I claim as new and desire to be secured by Letters Patent of the United States are:

1. A separable cutting mechanism for a printer, said mechanism comprises:

a printing device with rollers thereon to mount said printing device on a rail of said printer to move transversely;

a cutting-knife unit with a carrier having rollers thereon to mount said cutting-knife unit on said rail of said printer and being installed in juxtaposition with a plurality of printing heads; and an electromagnetic connector provided between said printing heads and a carrier of said cutting-knife unit, said electromagnetic connector is provided with a magnetizing coil to generate attraction or releasing action during operations;

therefore, said cutting-knife unit and said printing device are mutually attracted or separated for independent operations.

2. The separable cutting mechanism for a printer as in claim 1, wherein said electromagnetic connector is composed of an electromagnetic block and a metallic block adapted to being attracted, said metallic block is rectangular and has on one edge thereof locking holes, said electromagnetic block has a case that has locking holes on both ends, said case is provided therein with a magnetizing coil and is provided externally thereof with a magnetic conductive surface.

3. The separable cutting mechanism for a printer as in claim 2, wherein said printing device is composed of four printing heads having four monochromatic cartridges, and provided on the side of the outermost printing head with said electromagnetic block, said cutting-knife unit with said carrier has a cutting knife thereon, said carrier is provided on one edge thereof with a locking plate for locking said electromagnetic block.

* * * * *